US010892090B2

(12) United States Patent
Petzold

(10) Patent No.: US 10,892,090 B2
(45) Date of Patent: Jan. 12, 2021

(54) MAGNET CORE FOR LOW-FREQUENCY APPLICATIONS AND METHOD FOR PRODUCING A MAGNET CORE FOR LOW-FREQUENCY APPLICATIONS

(71) Applicant: Vacuumschmelze GmbH & Co. KG, Hanau (DE)

(72) Inventor: Jörg Petzold, Kahl (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 437 days.

(21) Appl. No.: 15/214,138

(22) Filed: Jul. 19, 2016

(65) Prior Publication Data

US 2017/0011846 A1 Jan. 12, 2017
US 2020/0227204 A9 Jul. 16, 2020

Related U.S. Application Data

(62) Division of application No. 13/814,457, filed as application No. PCT/IB2011/053515 on Aug. 15, 2011, now abandoned.

(30) Foreign Application Priority Data

Aug. 6, 2010 (EP) ..... 10172135

(51) Int. Cl.
*H01F 41/02* (2006.01)
*C21D 9/00* (2006.01)
(Continued)

(52) U.S. Cl.
CPC ..... *H01F 41/0213* (2013.01); *C21D 9/0068* (2013.01); *C22C 1/02* (2013.01);
(Continued)

(58) Field of Classification Search
None
See application file for complete search history.

(56) References Cited

U.S. PATENT DOCUMENTS 4,753,822 A * 6/1988 Van Mensvoort ..... C23C 18/1212 29/609
6,425,960 B1 * 7/2002 Yoshizawa ..... H01F 1/15308 148/121
(Continued)

FOREIGN PATENT DOCUMENTS

CN 1475018 A 2/2004
CN 1954394 A 4/2007
(Continued)

OTHER PUBLICATIONS

Chinese Office Action with translation for corresponding CN Application No. 201180038894.8 dated Dec. 16, 2014.
(Continued)

*Primary Examiner* — Xiaowei Su
(74) *Attorney, Agent, or Firm* — Dickinson Wright PLLC

(57) ABSTRACT

A magnet core for low-frequency applications and method for producing a magnet core for low-frequency applications is provided. The magnet core is made of a spiral-wound, soft-magnetic, nanocrystalline strip. The strip essentially has the alloy composition $Fe_{Rest}Co_aCu_bNb_cSi_dB_eC_f$, wherein a, b, c, d, e and f are stated in atomic percent and $0 \le a \le 1$; $0.7 \le b \le 1.4$; $2.5 \le c \le 3.5$; $14.5 \le d \le 16.5$; $5.5 \le e \le 8$ and $0 \le f \le 1$, and cobalt may wholly or partially be replaced by nickel. The magnet core has a saturation magnetostriction $\lambda_s$ of $\lambda_s < 2$ ppm, a starting permeability $\mu_1$ of $\mu_1 > 100\,000$ and a maximum permeability $\mu_{max}$ of $\mu_{max} > 400\,000$. In addition, a sealing metal oxide coating is provided on the surfaces of the strip.

14 Claims, 8 Drawing Sheets

(51) Int. Cl.

| | |
|---|---|
| ***H01F 1/147*** | (2006.01) |
| ***C22C 38/16*** | (2006.01) |
| ***C22C 38/10*** | (2006.01) |
| ***C22C 38/02*** | (2006.01) |
| ***C22C 38/00*** | (2006.01) |
| ***C22C 38/12*** | (2006.01) |
| ***H01F 1/153*** | (2006.01) |
| ***H01F 3/04*** | (2006.01) |
| ***C22C 1/02*** | (2006.01) |
| ***H01F 27/25*** | (2006.01) |
| ***C23C 22/05*** | (2006.01) |

(52) U.S. Cl.

CPC ..... *C22C 38/002* (2013.01); *C22C 38/02* (2013.01); *C22C 38/10* (2013.01); *C22C 38/12* (2013.01); *C22C 38/16* (2013.01); *C23C 22/05* (2013.01); *H01F 1/14766* (2013.01); *H01F 1/15308* (2013.01); *H01F 1/15333* (2013.01); *H01F 3/04* (2013.01); *H01F 27/25* (2013.01); *H01F 41/02* (2013.01); *H01F 41/0226* (2013.01); *Y10T 29/4902* (2015.01)

(56) References Cited

U.S. PATENT DOCUMENTS

| | | | | |
|---|---|---|---|---|
| 7,442,263 | B2 | 10/2008 | Günther et al. | |
| 7,563,331 | B2 | 7/2009 | Petzold et al. | |
| 2007/0126546 | A1 | 6/2007 | Guenther et al. | |
| 2007/0273467 | A1 | 11/2007 | Petzold et al. | |
| 2008/0092366 | A1* | 4/2008 | Guenther | C22C 38/002 29/607 |
| 2009/0065100 | A1 | 3/2009 | Yoshizawa et al. | |
| 2010/0230010 | A1* | 9/2010 | Yoshizawa | B82Y 30/00 148/304 |
| 2010/0265016 | A1 | 10/2010 | Petzold et al. | |

FOREIGN PATENT DOCUMENTS

| | | | |
|---|---|---|---|
| CN | 101351571 | A | 1/2009 |
| DE | 4210748 | C1 | 12/1993 |
| EP | 0392204 | A2 | 10/1990 |
| EP | 0695812 | A1 | 7/1996 |
| EP | 1710812 | A1 | 10/2006 |
| GB | 2453673 | A | 4/2009 |
| WO | 2007122592 | A2 | 11/2007 |
| WO | 2009012938 | A1 | 1/2009 |

OTHER PUBLICATIONS

International Search Report (PCT/ISA/210) dated Oct. 7, 2011, by the European Patent Office as the International Searching Authority for International Application No. PCT/IB2011/053515.

Written Opinion (PCT/ISA/237) dated Oct. 7, 2011, by the European Patent Office as the International Searching Authority for International Application No. PCT/IB2011/053515.

Japanese Office Action for Patent Appln No. 1013-522339 dated Feb. 24, 2014.

* cited by examiner

MAGNET CORE FOR LOW-FREQUENCY APPLICATIONS AND METHOD FOR PRODUCING A MAGNET CORE FOR LOW-FREQUENCY APPLICATIONS

CROSS-REFERENCE TO RELATED APPLICATIONS

This application is a divisional application of U.S. patent application Ser. No. 13/814,457 filed Apr. 9, 2013 which is a U.S. National Phase Application of PCT/IB2011/053515 filed Aug. 15, 2011 which claims benefit of European Patent Application No. EP 10172135.5 filed Aug. 6, 2010. The entire disclosures of each of the above applications are incorporated herein by reference.

BACKGROUND

1. Field of the Invention

The invention relates to a magnet core for low-frequency applications, which is made of a spiral-wound, soft-magnetic, nanocrystalline strip, the magnet core being particularly suitable for use in residual current devices (RCDs).

2. Related Art

Residual current devices protect humans and equipment against electric shock. According to DIN EN 61008/DIN VDE 0664, the energy for actuating the trigger which causes the disconnection has to be supplied exclusively by the residual current. Tripping currents of 300 mA, 500 mA or 1000 mA are typical for the protection of equipment. For protection of humans, the tripping current must not exceed 30 mA. Special devices for humans may even have tripping thresholds of 10 mA. According to the standard, the residual current devices have to operate faultlessly within a range between −5° C. and 80° C. Residual current devices subject to enhanced requirements even have an operating range between −25° C. and 100° C. There is a distinction between AC-sensitive and pulse current-sensitive RCDs.

AC-sensitive RCDs have to have the required sensitivity to sinusoidal residual currents. They have to trip reliably both at suddenly and at slowly rising residual currents, which involves certain requirements in terms of the eddy current behavior of the material. In this case, the residual current transformer is driven in a bipolar fashion. If there is a residual current, its secondary voltage has to be at least sufficient to trigger the magnet system of the trigger. For a space-saving arrangement of the transformer core, a material is required which has as high a permeability as possible at the typical operating frequency of 50 Hz. As very high 50 Hz permeability values can be obtained with the R-loop (circular form of the hysteresis loop) both in the starting permeability range and at the field strength of maximum permeability, the R-loop has largely been accepted for exclusively AC-sensitive RCDs. The optimum operating point lies in the range of maximum permeability or slightly higher.

Pulse current-sensitive RCDs moreover have to trigger reliably and independently of the direction of the current even at single- or double-way rectified currents with and without phase control and with a superimposed DC component. In view of the high remnant induction, transformers with a circular loop only have a small unipolar induction stroke, so that the supplied tripping voltage may be too low at pulsed residual currents. This results in an increased use of transformer cores with a flat loop, which, although having a high unipolar induction stroke, have significantly lower permeability values than those with a circular loop.

In order to obtain a reliable tripping behavior in the required residual current range, the tripping power to be applied by the transformer core should be as high as possible. In this respect, the essential influencing factors are the geometry of the core and the magnetic properties of the material combined with the technological refinement of the material, for example by means of a heat treatment.

Details of transformer materials for AC- and pulse current-sensitive RCDs are presented in various publications, for example in A. Winkler, H. Zürneck, M. Emsermann: "Auslöse-and Langzeitverhalten von Fehlerstrom-Schutzschaltern" (Tripping and long-term behaviour of residual current devices), published by Schriftenreihe von der Bundesanstalt für Arbeitsschutz, Fb 531 (1988); F. Pfeifer, H. Wegerle: "Werkstoffe für pulssensitive Fehlerstrom-Schutzschalter" (Materials for pulse-sensitive residual current devices), Berichte der Arbeitsgemeinschaft Magnetismus, vol. 1 (1982), p. 120-165; "Ringbandkerne für pulssensitive Fehlerstrom-Schutzschalter" (Annular strip cores for pulse-sensitive residual current devices), Publication PW-002 by Vacuumschmelze GmbH and R. Rösch: "Siemens Energietechnik" (Siemens Energy Technology), 3, vol. 6, p. 208-211 (1981).

In earlier years, core-balance transformers made of NiFe alloys were used almost exclusively. Here, the highly permeable 75-80% NiFe materials (also known as "μ-metal" or "permalloy") having a circular or flat loop were particularly suitable for sensitive operator protection devices. These materials have a saturation induction of approximately 0.8 T and reach maximum permeability values of 300 000 and more. This being said, their dynamic properties are not ideal for the transmission of the harmonic component in non-sinusoidal residual currents. This is due to the relatively great strip thicknesses of 50 to 150 μm and the relatively low resistivity of 0.5 μΩm≤ρ≤0.6 μΩm. Furthermore, the adjustment of a suitable behavior of the temperature coefficient involves complex and costly heat treatment.

Nanocrystalline FeCuNbSiB materials have recently been used in pulse current-sensitive RCDs as well. Important advantages of these materials are their high saturation induction of approximately 1.2 T and the excellent linearity of the F-loop (flat hysteresis loop) of $\mu_4/\mu_{15}$=0.65-0.95 at an easily adjustable μ-level of more than 100 000. In addition, these materials have excellent dynamic properties, which are due to a low strip thickness of 15-30 μm and a comparatively high resistivity of 1.1 μΩm≤ρ≤1.3 μΩm. Such materials are referred to in DE 42 10 748 C1.

For AC-sensitive transformer cores with R-loop which are made of nanocrystalline alloys, EP 0 392 204 B1 discloses a relatively low remanence ratio of $B_R/B_S$=40%-70%, which favors a good frequency response, a good temperature stability of permeability and $\mu_{10}$=398 000. EP 1 710 812 A1 relates to the same alloy and claims a field-induced quasi-Z-loop with $\mu_{max}$>350 000 and a high remanence ratio of $B_R/B_S$>70%. At the same time, it is claimed that this maximum permeability is reached at applied field strengths between 5 and 15 mA/cm. As the magnetization process of Z-loops is based on wall displacement processes the activation of which requires a minimum field strength depending on the material used, the low-level signal permeability, in particular the starting permeability such as $\mu_1$, is particularly low. Moreover, the frequency response of the permeability and the behavior in fast magnetization processes are not optimal, because permeability is reduced greatly even in the low-frequency range owing to pronounced eddy current anomalies. Such cores are therefore not ideal for low-level residual current signals.

Such magnet cores are usually subjected to a heat treatment in the magnetic field. If this is to be economical, the cores have to be stacked for the heat treatment. Owing to the locus-dependency of the demagnetization factor of a cylinder, the stacked cores are magnetized in a locus-dependent manner in the axial direction even in weak stray fields such as the terrestrial field. In the anisotropies induced by the magnetic field, which are of necessity very small for the application in question, this results in a pronounced locus-dependent scatter of magnetic properties. These are for example reflected in permeability variations which require considerable sorting and after-treatment efforts in the manufacturing process. The dead weight of the stacked cores furthermore results in an asymmetric, magneto-mechanically induced course of the magnetic values along the stack.

To solve this problem, U.S. Pat. No. 7,563,331 B1 proposes a continuous annealing method in which the cores are annealed individually and therefore actually field-free and without any mechanical loading. Starting permeability values $\mu_1$>100 000 and maximum permeability values above 620 000 were obtained in this process. However, as manufacture using such a continuous method shows, great permeability setbacks combined with increased coercitive field strengths and reduced remanence ratios are experienced here as well; these have so far not been explained. Similar effects were observed in stack annealing processes in conventional batch furnaces.

SUMMARY

The invention is therefore based on the problem of further developing the prior art referred to above and of providing from the alloy system $(Fe_{1-a}Ma)_{100-x-y-z-\alpha-\beta-\gamma}Cu_xSi_yB_zM'_\alpha M_\beta X_\gamma$ nanocrystalline annular strip cores having a maximum permeability for RCDs and which can moreover be produced efficiently on an industrial scale. In this context, Ma=Co,Ni;$0 \le a \le 0.5$, and $0.1 \le x \le 3$ $0 \le y \le 30$ $0 \le z \le 25$ $0.1 \le \alpha \le 30$ $0 \le \beta \le 10$ $0 \le \gamma \le 10$ and M'=Nb, W, Ta, Zr, Hf, Ti, Mo M"=V, Cr, Mn, Al, Pt, Ni, Pd, Y, La, rare earth metals, Au, Zn, Sn, Re X=C, Ge, P, Ga, Sb, In, Be, As and all values are stated in atomic percent.

The present invention is further based on the problem of specifying a method for producing such an annular strip core which can be used efficiently in industrial-scale production.

According to the invention, this problem is solved by the subject matter of the independent claims. Advantageous further developments of the invention form the subject matter of the dependent claims.

The starting material of these alloys is first produced as an amorphous strip using melt spinning technology. The annular strip cores wound from this material are subjected to a heat treatment in which the amorphous state is converted into a nanocrystalline two-phase structure with outstanding soft magnetic properties. An important precondition for obtaining maximum permeability values on an industrial scale across a wide field strength range of 1 mA/cm to above 50 mA/cm is a minimizing of magnetostriction (saturation magnetostriction) to values of $|\lambda_s|<6$ ppm, better $|\lambda_s|<2.5$ ppm and even better $|\lambda_s|<1$ ppm. For this purpose, the alloy spectrum has to be restricted on the one hand, and on the other hand in the heat treatment process the crystallization temperature has to be adapted alloy-specifically for the generation and maturation of the nano-grain in such a way that the volume fraction of the nanocrystalline phase having a low or even negative magnetostriction component is so pronounced that the high positive magnetostriction component of the amorphous residual phase is compensated for as well as possible.

According to an aspect of the invention, the magnet core for low-frequency applications is made of a spiral-wound, soft-magnetic, nanocrystalline strip, the strip essentially having the alloy composition FeRestCoaCubNbcSidBeCf, wherein a, b, c, d, e and f are stated in atomic percent and $0 \le a \le 1$; $0.7 \le b \le 1.4$; $2.5 \le c \le 3.5$; $14.5 \le d \le 16.5$; $5.5 \le e \le 8$ and $0 \le f \le 1$, and cobalt may wholly or partially be replaced by nickel, the magnet core having a saturation magnetostriction $\lambda_s$ of $|\lambda_s|<2$ ppm, a starting permeability $\mu_1$ of $\mu_1$>100 000 and a maximum permeability $\mu_{max}$ of $\mu_{max}$>400 000, and a sealing metal oxide coating being provided on the surfaces of the strip.

A strip which essentially has a specific alloy composition should hereinafter be understood to be a strip made of an alloy which may in addition contain production-related impurities of other elements in low concentrations.

A sealing coating provided on the surfaces of the strip should hereinafter be understood to be a coating which tightly seals most parts of or even the whole surface of the strip.

The magnetostriction of such alloys can to the largest extent be adjusted to zero by suitable heat treatment. This makes the magnetic values immune against mechanical influences, which enables a broad spectrum of core shapes and mountings to be used. Depending on the heat treatment used, the temperature characteristic of permeability can become negative, which may be advantageous in various embodiments of RCDs.

For the zero adjustment of magnetostriction, the heat treatment is advantageously carried out in such a way that the local magnetostriction contributions of the nano-grain and the amorphous residual phase balance as well as possible.

Investigation have, however, found that the strip surfaces have a noticeable trend towards crystalline deposits at the required temperatures above 540° C. Depending on the Si, Nb, B or C content, these may consist of the known $FeB_2$ phases or of nanocrystalline deposits such as $Fe_2O_3$, $Fe_3O_4$ and $Nb_2O_5$. Their generation is supported by the roughness of the strip surfaces, an increased strip thickness or an excessively low metalloid content, but also by metal/gas reactions between impurities in the inert gas and the strip surface. In addition, the generation of oxide surface layers such as $SiO_2$ plays an important part. The crystal anisotropies and strains developing in such surface effects result in increased coercitive field strengths, low remanence values and reduced permeability values. The formation of crystalline deposits can, however, be avoided by means of the sealing coating.

It is further advantageous in the industrial-scale production for magnetostriction-free, maximum-permeability magnet cores if certain specifications are adhered to in respect of alloy composition, strip geometry, the temperature control of the heat treatment and the quality of the inert gas atmosphere.

It has been found that it is advantageous if the strip has a strip thickness d<24 μm, preferably d<21 μm.

In one embodiment, the strip has an effective roughness $R_a$(eff) of $R_a$(eff)<7%, preferably $R_a$(eff)<5%. The effective roughness is in practical terms determined by means of the Rugotest or the profile method.

In one embodiment, the strip has a total metalloid content c+d+e+f>22.5 atomic %, preferably c+d+e+f>23.5 atomic %.

According to one embodiment, the oxide coating contains magnesium oxide. According to a further embodiment, the oxide coating contains zirconium oxide. As an alternative or in addition, the oxide coating may contain oxides of an element selected from the group of Be, Al, Ti, V, Nb, Ta, Ce, Nd, Gd, further elements of the $2^{nd}$ and $3^{rd}$ main groups and of the group of rare earth metals.

Such a coating of the strip before heat treatment allows the heat treatment to be carried out at the relatively high temperature required for the adjustment of magnetostriction without having to deal with crystalline deposits and/or glassy $SiO_2$ layers and the resulting adverse effects on magnetic values.

This procedure allows the production of magnet cores having a maximum permeability $\mu_1$ of $\mu_1$>150 000, preferably $\mu_1$>200 000, and the magnet core can have a remanence ratio of $B_R/B_S$ of $B_R/B_S$>70%.

The saturation magnetostriction $\lambda_s$ can be restricted to $|\lambda_s|$<1 ppm, preferably $|\lambda_s|$<0.5 ppm.

Owing to its low magnetostriction, the finished magnet core is no longer highly sensitive against strains. As a result, it can for example be secured in a protective tray using an adhesive and/or a ring made of an elastic material and placed on one or both of the end faces of the magnet core for cushioning. Particularly suitable adhesives are silicone rubber, acrylate or silicone grease.

To fix the strip layers, the magnet core can be provided with an epoxy fluidized bed coating.

According to one aspect of the invention, such a magnet core is used in a residual current device.

According to one aspect of the invention, a method for producing a magnet core for low-frequency applications from a spiral-wound, soft-magnetic, nanocrystalline strip is provided, the strip essentially having the alloy composition FeRestCoaCubNbcSidBeCf, wherein a, b, c, d, e and f are stated in atomic percent and 0≤a≤1; 0.7≤b≤1.4; 2.5≤c≤3.5; 14.5≤d≤16.5; 5.5≤e≤8 and 0≤f≤1, and cobalt may wholly or partially be replaced by nickel. The strip is provided with a coating with a metal oxide solution and/or an acetyl-acetone-chelate complex with a metal, which coating forms a sealing metal oxide coating during a subsequent heat treatment for the nano-crystallisation of the strip. In the heat treatment for the nanocrystallisation of the strip, a saturation magnetostriction $\lambda_s$ of $|\lambda_s|$<2 ppm, preferably $|\lambda_s|$<1 ppm, preferably $|\lambda_s|$<0.5 ppm is set.

The metal for the coating is advantageously an element selected from the group Mg, Zr, Be, Al, Ti, V, Nb, Ta, Ce, Nd, Gd, further elements of the $2^{nd}$ and $3^{rd}$ main groups and of the group of rare earth metals.

For large-scale manufacture, the following methods can be used in order to obtain as high a permeability as possible combined with low magnetostriction:

To obtain as perfect a field-free core as possible, the heat treatment is performed in a continuous process on non-stacked magnet cores in a field-free manner.

In one embodiment, the non-stacked magnet cores are placed on a carrier having a good thermal conductivity in the continuous annealing process. Such a carrier consists for example of a metal having a good thermal conductivity, such as copper, silver or heat-conducting steel. A bed of ceramic powder having a good thermal conductivity is also a suitable carrier.

The annular strip cores can for example be placed endwise on copper plates with a thickness of at least 4 mm, preferably at least 6 mm and even better at least 10 mm. This contributes to the prevention of local overheating at the start of the exothermal crystallization, because the crystallization heat is dissipated effectively. In addition, it may be advantageous if the magnet core passes through the following temperature zones during the heat treatment:

a first heating zone in which the magnet core is heated to a crystallisation temperature;

a constant or slightly rising decay zone with a temperature slightly above the crystallization temperature, the passage through the decay zone lasting at least 10 minutes;

a second heating zone in which the magnet core is heated to a maturation temperature for setting the nanocrystalline structure;

a maturation zone with a substantially constant maturation temperature $T_x$ between 540° C. and 600° C., the passage through the maturation zone lasting at least 15 minutes.

The dwell in the decay zone ensures that the crystallization heat decays before a further heating of the magnet core, thereby preventing local overheating.

In one embodiment, the heat treatment is carried out in an inert gas atmosphere of $H_2$, $N_2$ and/or Ar, the dew point $T_P$ being <−25° C., preferably $T_P$<−49.5° C.

In order to avoid mechanical stresses as far as possible if the magnetostriction is not fully balanced, the strip is wound at a descending skew to produce the magnet core.

BRIEF DESCRIPTION OF THE DRAWINGS

Embodiments of the invention are explained in greater detail below with reference to the accompanying figures.

DETAILED DESCRIPTION OF EXAMPLE EMBODIMENTS

Figure 1:
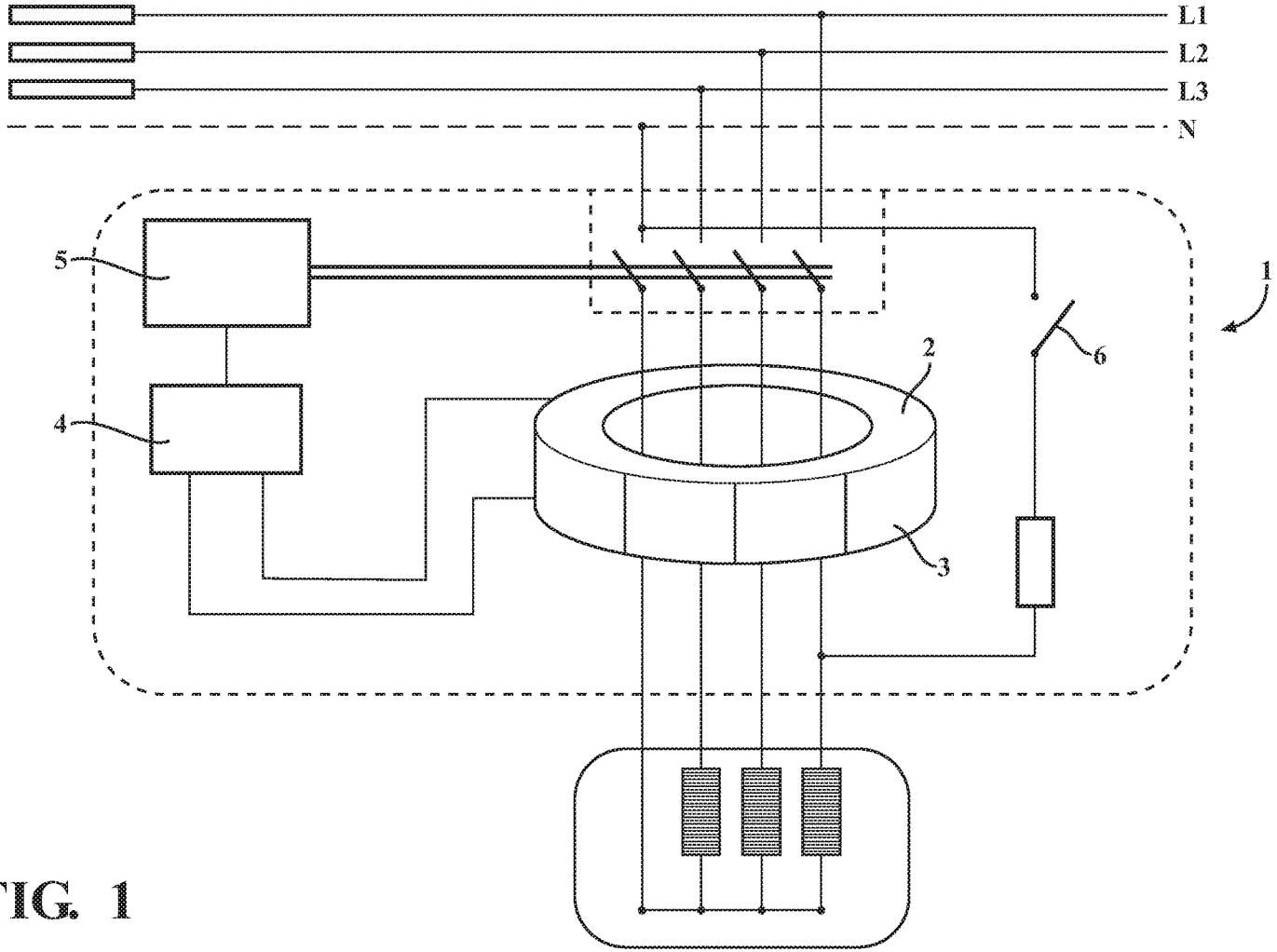
FIG. 1 is a diagrammatic representation of an AC-sensitive RCD according to an embodiment of the invention.

FIG. 1 is a diagrammatic representation of an AC-sensitive RCD 1 which disconnects all poles of the monitored circuit from the rest of the network if a specified residual current is exceeded.

The currents flowing through the RCD 1 are compared in a core-balance transformer 2 which adds the currents flowing to the load with correct signs. If a current in the circuit is discharged to earth, the sum of inward and return current in the core-balance transformer is unequal to zero; the result is a current differential leading to the response of the residual current device 1 and to the disconnection of the power supply.

The core-balance transformer 2 has a magnet core 2 wound from a nanocrystalline, soft-magnetic strip. The RCD 1 further comprises a tripping relay 4, a preloaded latching mechanism 5 and a test button 6 for manually checking the RCD 1.

Figure 2:
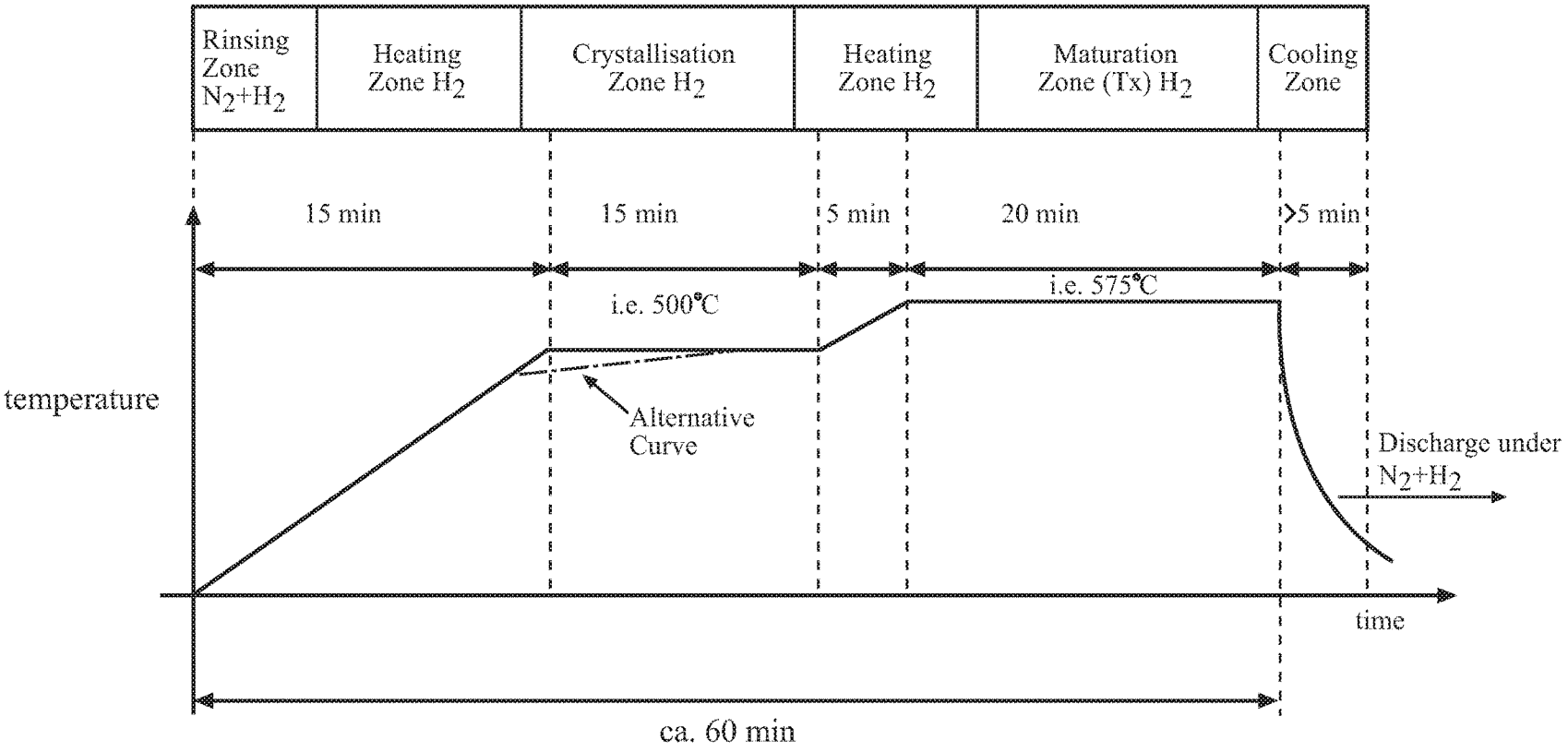
FIG. 2 is a diagrammatic representation of a possible temperature curve of a heat treatment according to a method for producing a magnet core according to an embodiment of the invention.

FIG. 2 is a diagrammatic representation of a possible temperature curve of a heat treatment according to a method for producing a magnet core according to an embodiment of the invention.

In this continuous heat treatment process, an initial heating of the magnet core is followed by a much slower increase or even by a temperature plateau (both alternatives are shown in FIG. 2), in order to let the exothermal crystallization heat decay before the higher temperature used for the maturation of the structure is established. In this way local overheating of the core is avoided. The subsequent maturation of the structure for setting the final magnetic values is then performed at the temperature $T_x$ in the downstream temperature plateau of the "maturation zone".

Using a pre-sample, the temperature in the maturation zone is adapted to the composition of the respective batch in such a way that magnetostriction values become minimal. Of the strip batches to be used, pre-samples are first produced and subjected to different temperatures $T_x$ between 540° C. and 600° C. in the maturation zone. The magnetostriction is then determined either directly on a piece of strip or indirectly on an undamaged core. Direct measurement can for example be performed by means of the SAMR method. An indirect method is a pressure test in which the circumference of the annular strip core is deformed into an oval, for example by 2%. The change in coercitive field strength which occurs in this process is determined by measuring the quasi-static hysteresis loop by means of a Remagraph.

Figure 4:
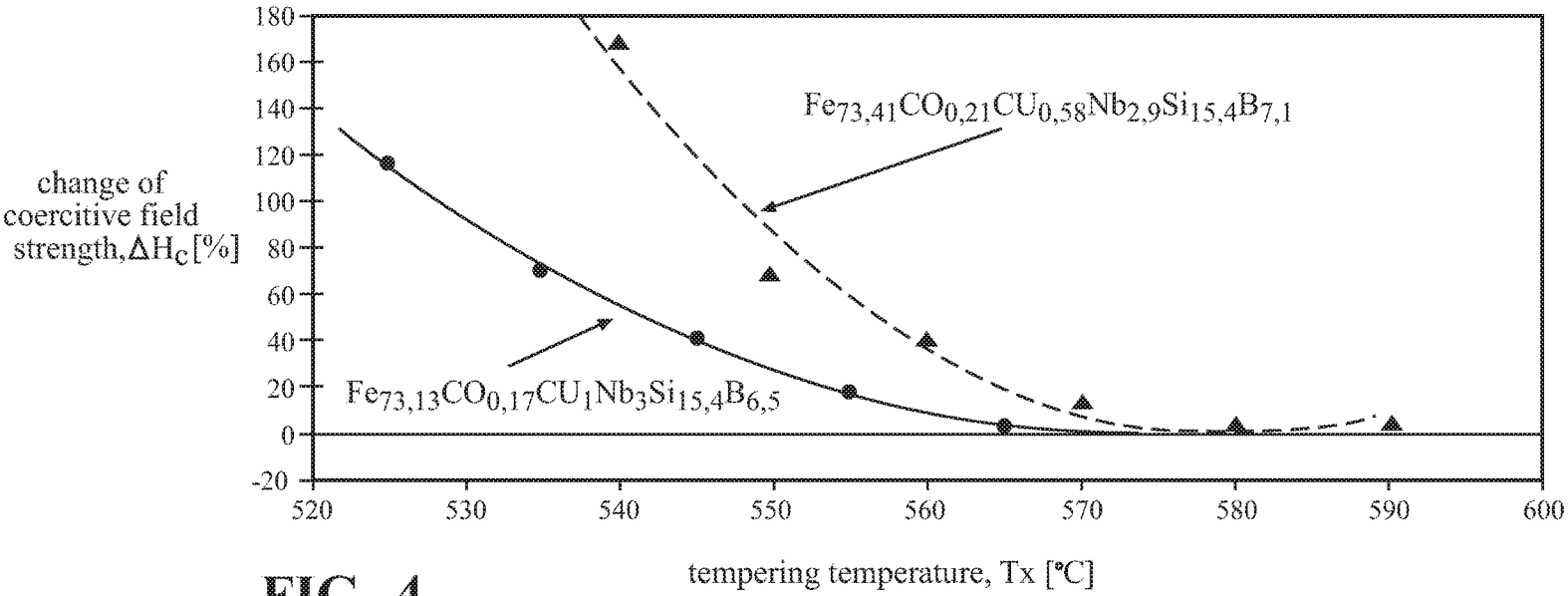
FIG. 4 is a diagram illustrating the influence of crystallization temperature on the change of the coercitive field strength of a magnet core under radial deformation.

As FIG. 4 shows, the batch-specific optimum value for $T_x$ can be read at the point where the change $\Delta H_C$ is minimal or even tends towards zero.

On the basis of this method, magnetic values (at 50 Hz) can be obtained in an alloy such as $Fe_{73.13}Co_{0.17}Cu_1Nb_3Si_{15.8}B_{6.9}$ on a large scale which lie in the range of $\mu_1$=120 000-300 000 and $\mu_{10}$>450 000, as well as $B_r/B_s$>70% (measured quasistically). According to FIG. 4, the optimum temperature $T_x$ in this case is approximately 570° C. In an alloy composition $Fe_{73.41}Co_{0.21}Cu_{0.98}Nb_{2.9}Si_{15.4}B_{7.1}$, on the other hand, the zero cross-over of magnetostriction is only reached at $T_x$=580° C. to 585° C. In the same way, the optimum temperature found for the alloy $Fe_{73.38}Co_{0.11}Cu_{1.01}Nb_{2.9}Si_{16}B_{6.6}$ was $T_x$=564° C.

Figure 3:
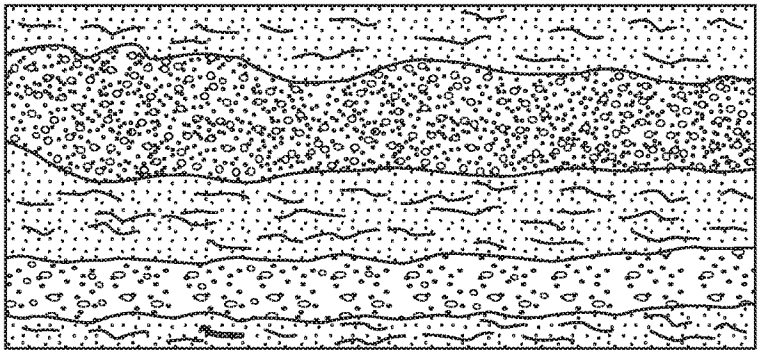
FIG. 3 shows the surface of an uncoated strip after heat treatment.

If a large quantity of cores is annealed at the same time in large-scale production, a large amount of moisture which adheres to the surface of the strip wound into cores is dragged into the furnace system. On the one hand, this results in direct local corrosive surface reactions on the strip, and on the other hand, some of the moisture is diffused into the inert gas atmosphere and there increases the dew point in an undesirable way. In these conditions, crystalline deposits form on the strip surfaces; as FIG. 3 shows, these largely accumulate in the air pockets. As a surface analysis showed, these crystallites consist of $Fe_2O_3$, $Fe_3O_4$ or $Nb_2O_5$ and are therefore due to oxide reactions during the heat treatment process.

A further undesirable surface effect supported by increased dew points, which is superimposed on the crystalline deposits, is the growth of a glassy $SiO_2$ layer. This is rigid and has a considerably lower coefficient of thermal expansion of 0.45 to 1 ppm/K than the strip material (approx. 10 ppm/K). As the bulk material contracts by 1-2% during the generation and maturation of the nanocrystalline grains, mechanical stresses build up. These likewise result in strong anisotropies which affect the magnetic values in an undesirable way.

The surface sample shown in FIG. 3 was taken from an assembly of 5000 cores having dimensions of 10.5 mm×7 mm×6 mm, which were wound from a strip having the composition of $Fe_{73.13}Co_{0.17}Cu_1Nb_3Si_{15.8}B_{6.9}$. 100 each of these cores were placed endwise on square copper plates having dimensions of 300 mm×300 mm×6 mm and successively annealed in a continuous furnace at a temperature profile corresponding to FIG. 2. The formation and maturation of the nano-grain occurred at the temperature $T_x$=575° C., which is the optimum temperature for the zero adjustment of magnetostriction.

The humidity drawn into the furnace was detected by measuring the dew point of the $H_2$ inert gas by means of a device called PARAMETRICS MIS1. Before the entry of the annular strip cores into the heating zone, this was −42° C., reaching a comparably high value of −16° C. as the cores passed through the heating zone. Owing to the parasitic anisotropies of the two superimposed surface effects, the magnetic values of the annealed cores were not optimal. The average batch values measured at 50 Hz were in the range of $\langle\mu_1\rangle$=47 873, $\langle\mu_{10}\rangle$=222 356, $\langle B_R/B_S\rangle$=52% and $\langle H_e\rangle$=28 mA/cm.

To avoid such parasitic effects, the sealing coating of the strip surfaces with an annealing-tolerant substance has proved useful. Suitable materials are dissolved substances the starting materials of which form a thermally stable oxide layer in the annealing process in an $H_2$, $N_2$ or Ar inert gas atmosphere or mixtures thereof at temperatures up to 650° C. without being reduced by the effect of the inert gases.

Examples for base materials for such coatings are Be, Mg, Al, Zr, Ti, V, Nb, Ta, Ce, Nd, Gd and other elements of the $2^{nd}$ and $3^{rd}$ main groups and the group of rare earth elements. These are applied to the strip surfaces in the form of metal alkoxide solutions in the corresponding alcohol or ether, e.g. methylate, ethylate, propylate or butylate solutions in the corresponding alcohol or ether, or alternatively as tri- or tetra-isopropyl alkoxides. Further alternatives are acetylacetone-chelate complexes with the above metals. Under the influence of atmospheric humidity, these are converted into the respective hydrated hydroxides in the subsequent drying process at 80° C. to 200° C. In the later heat treatment process, this releases further water and becomes the respective metal oxide, resulting in a dense protective layer which adheres firmly to the surface and seals it. Typical layer thicknesses lie in the range of 0.05 to 5 μm, a layer thickness of 0.2 to 1 μm having sufficiently good properties and therefore being preferred in one embodiment.

With the coating, the material properties can be stabilized against surface reactions at the high temperatures required for the zero adjustment of magnetostriction. The application-relevant characteristic values influenced by surface effects are in particular the μ(H) characteristic measured at 50 Hz, the quasi-static coercitive field strength and the remnant induction.

At least three possible methods are available for applying the solution as starting product for the later formation of the sealing coating. The layer thicknesses referred to above can be obtained by adjusting concentration and by adapting the process parameters. If particularly thick layers are required, the process can be repeated.

In one possible method, the strip is continuously drawn via deflection rollers through the coating medium placed in a trough. Immediately before being wound to form a core, it passes through a drying section at a controlled temperature of 80-200° C. This Method results in a particularly uniform coating. Thicker layers can be obtained by a repeated passage.

In a further possible method, the strip, after being wound following its production, is dipped into the solution in a receiver in the form of a coil and evacuated. Owing to the effective capillary forces, which are sufficiently strong at a vacuum in the rough vacuum range of 10-300 mbar, the solution penetrates between the strip layers of the coil and wets the surfaces. The dried coils are then post-dried in a drying cabinet at 80-200° C. The coated strip is then wound to form magnet cores. This method is particularly economical.

In a further possible method, the cores wound from uncoated strip are dipped into the solution in a receiver. Following evacuation to the above vacuum, the solution penetrates between the strip layers and wets them. The dipped cores are then dried in a drying cabinet at 80-200° C. This method offers the advantage that the winding of the core cannot be affected by the coating medium on the strip surfaces.

Investigations have revealed that coatings with magnesium and zirconium are particularly easily processed, cost-effective and safe in processing.

The concentration of the dissolved metals was varied in the various organic solvents within a wide range between 0.1% and 5% by weight without causing any significant changes in the magnetic values. At very low concentrations, however, standard deviations were found to increase.

To check the effect of a surface coating, strips of the composition $Fe_{73.6}Co_{0.1}Cu_1Nb_{2.96}Si_{15.45}B_{6.84}C_{0.05}$ produced in a melt spinning process and having a width of 10 mm were divided into three part-quantities of identical quality (fill factor η=81.0-81.3%, $R_a$(eff)=2.9%). The first and second part-quantities remained uncoated, while the third part-quantity was coated with a solution of 3.6% Mg-methylate in a receiver in a dipping process. The rough vacuum generated by means of a rotary slide-valve pump was approximately 110 mbar at the end of evacuation time. After a dwell time of 15 minutes, the saturated coils were dried at 110° C. for one hour, resulting in an adhesive layer of hydrated $Mg(OH)_2$ with a thickness of 0.8 μm.

Both the coated and the uncoated strips were then wound at a descending skew to produce strain-free annular strip cores having dimensions of 32 mm×16 mm×10 mm. In preparation of heat treatment, 100 cores each were placed endwise in square copper plates having dimensions of 300 mm×300 mm×6 mm.

The subsequent heat treatment was carried out entirely field-free in a continuous process at a temperature profile similar to that shown in FIG. 2, the throughput speed through the heating zone being 0.16 m/min. Pure hydrogen with a dew point of −50° C. was used as an inert gas. Contrary to the presentation in FIG. 2, the temperature gradient in the first heating zone was increased such that the products reached a temperature of 480° C. after only 8 minutes. The temperature in the decay zone was not held constant, but increased to 505° C. along a 20 minute heating section. This was followed by a steep temperature gradient which the cores passed through within 3 minutes to reach the final maturation temperature $T_x$. The passage through this temperature range was completed within 25 minutes. The cores were then cooled to room temperature at the same throughput speed in a cooling zone significantly longer than that shown in FIG. 2 in the presence of hydrogen of the same dew point. This greatly reduced cooling rate was chosen to avoid cooling-related strain effects.

Figure 5:
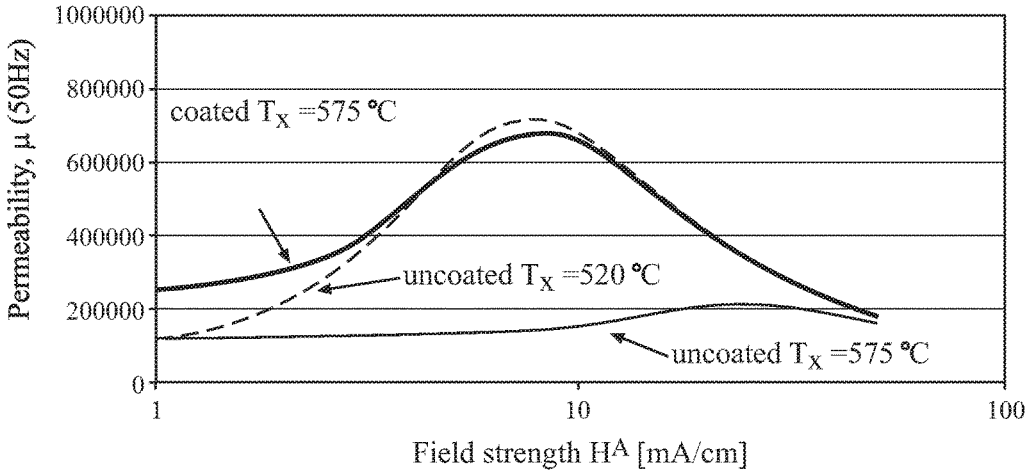
FIG. 5 is a diagram illustrating the influence of crystallization temperature and of a coating on the μ (H)-commutation curves of a magnet core.
Figure 6:
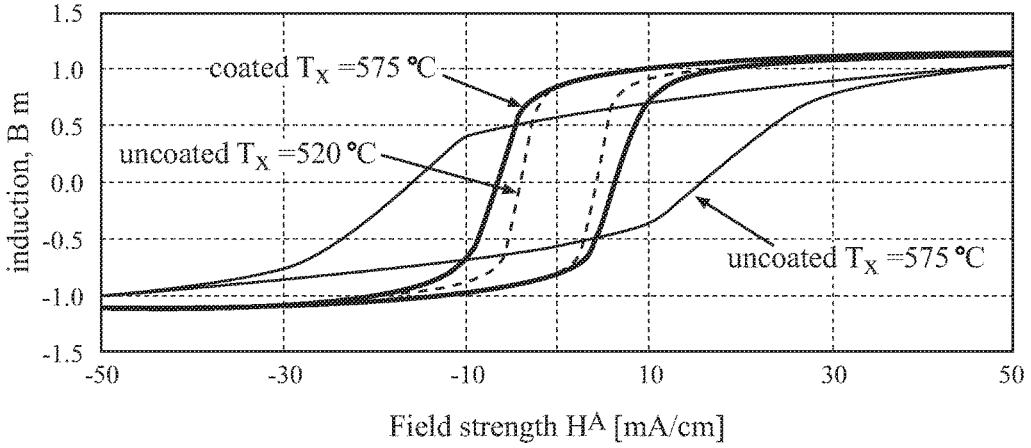
FIG. 6 is a diagram illustrating the influence of crystallization temperature and of a coating on the on the hysteresis loop of a magnet core.

To avoid overheating, which, together with atmospheric impurities, can result in increased surface reactions and thus in parasitic anisotropies, the maturation zone was for the first third of the cores made from uncoated strip adjusted as low as possible to $T_x$=520° C. The μ(H) characteristic measured at 50 Hz and the quasi-statically (f=0.01 Hz) measured hysteresis loops shown in FIGS. 5 and 6 show by way of example that after a heat treatment at $T_x$=520° C. high maximum permeability values of $\mu_s$=719 827 are reached, the starting permeability being $\mu_1$=105 238. The remanence ratio of $B_R/B_S$ was approximately 77%.

To protect against mechanical stresses caused by handling or processing steps, such as wire or conductor winding, these cores were bonded endwise into Ultramid troughs using silicone rubber as an adhesive. Owing to the magnetostriction of $\lambda_s$ measured by means of the SAMR method, the adhesive penetrating between the strip layers increased the quasi-static coercitive field strength from $H_c$=3.9 mA/cm to 8.6 mA/cm, while the maximum permeability measured at 50 Hz was reduced to $\mu_{16}$=373 242 and $B_R/B_S$ was reduced to 59%. Owing to their inadequate permeability, such cores were not suitable for use in RCDs.

The second third of the cores, uncoated like the first third, was annealed at a temperature $T_x$=575° C., which in the pre-sample was found to be optimal for the zero adjustment of magnetostriction, to $\lambda_2 \approx 0$ ppm.

In this case, however, the maximum permeability was reduced to 221 435, and the quasi-statically measured coercitive field strength of $H_c$=13.2 mA/cm was found to be very high-see FIGS. 5 and 6. The remanence ratios were only around 51%.

Figure 7:
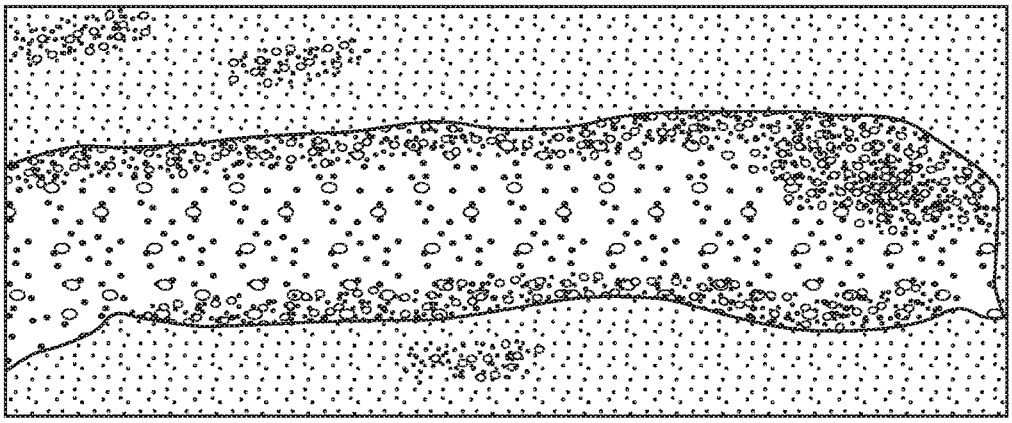
FIG. 7 is a view of the underside of an uncoated strip after heat treatment.
Figure 9:
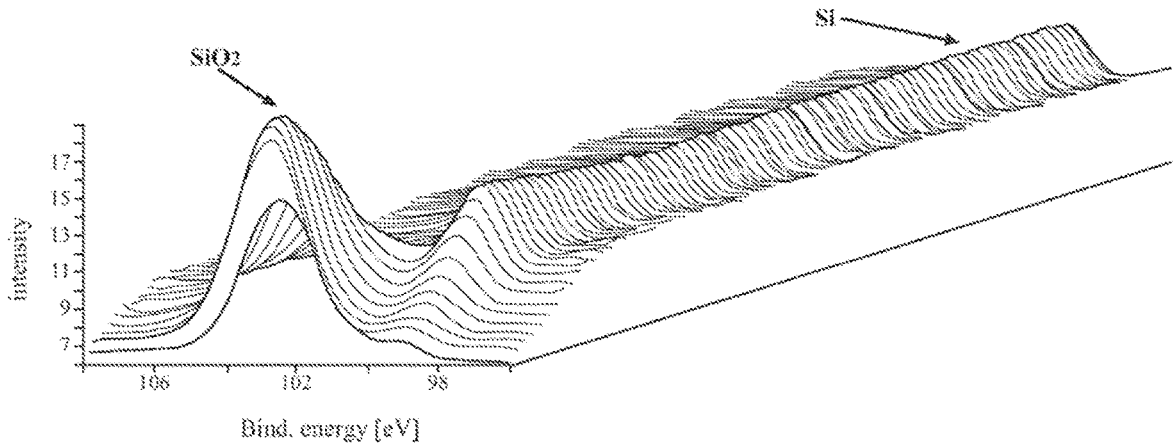
FIG. 9 shows an XPS depth profile of an uncoated strip after heat treatment.

To analyze the cause of these worse figures, the strip surfaces of the cores were checked by means of optical microscopy. As FIG. 7 shows, the air pockets on the underside of the strip were stratified with a dense layer of crystalline deposits which resulted in major parasitic anisotropies and a considerable degradation of the magnetic values. The surface analysis likewise performed on the underside of the strip by means of XPS (X-ray photoelectron spectroscopy—cf. Stefan Huffier, "Photoelectron Spectroscopy Principles and Applications", Springer, 3rd edition, 1995/1996/2003) showed in the depth profile according to FIG. 9 in addition the existence of a highly straining $SiO_2$ surface layer, which leads to major parasitic anisotropies. The structure of this layer is due to a segregation of Si atoms from the strip interior, followed by oxidation by residual atmospheric impurities.

The last third of the cores, which was coated with a 3.6% solution of Mg methylate, on the other hand, exhibited after annealing at $T_x$=575° C., very good values as shown in FIGS. 5 and 6: $H_c$ was approximately 7 mA/cm, maximum permeability approximately $\mu_8$=692 163, $B_R/B_S$ approximately 79%. At the same time, starting permeability $\mu_1$ rose to 243 562. Owing to the largely balanced magnetostriction of $\lambda_s \leq 0.1$ ppm, a single-trough experiment using a silicone rubber adhesive resulted in a virtually unchanged permeability of $\mu_8$=679 322. Comparable results were obtained with cores which were not bonded into a trough, but loosely installed with a 2 mm thick rubber cushioning ring placed on their end faces.

Figure 8:
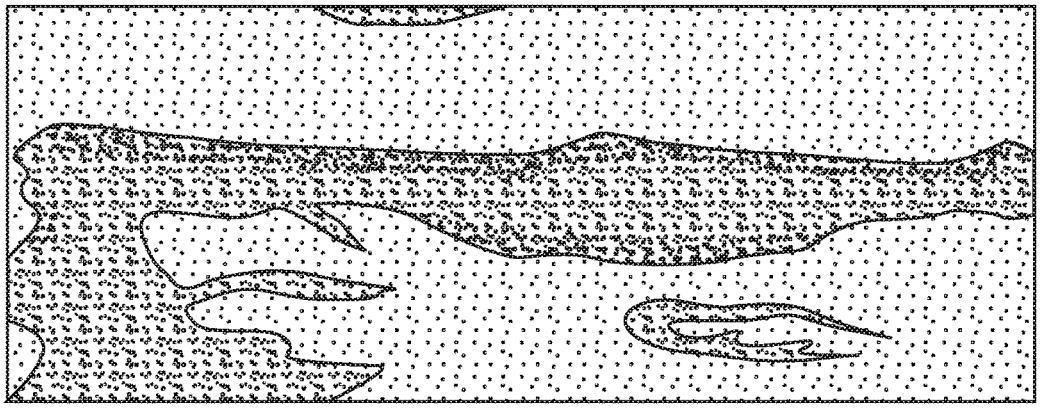
FIG. 8 is a view of the underside of a coated strip after heat treatment.
Figure 10:
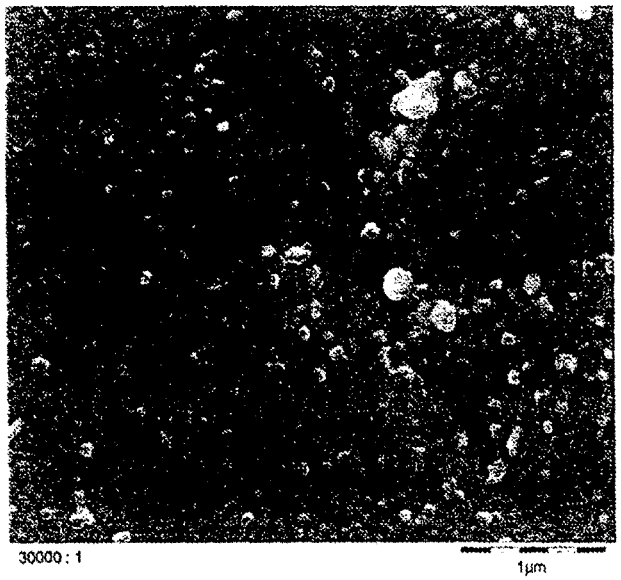
FIG. 10 is a scanning electron microscopy shot of a coated strip underside.
Figure 11:
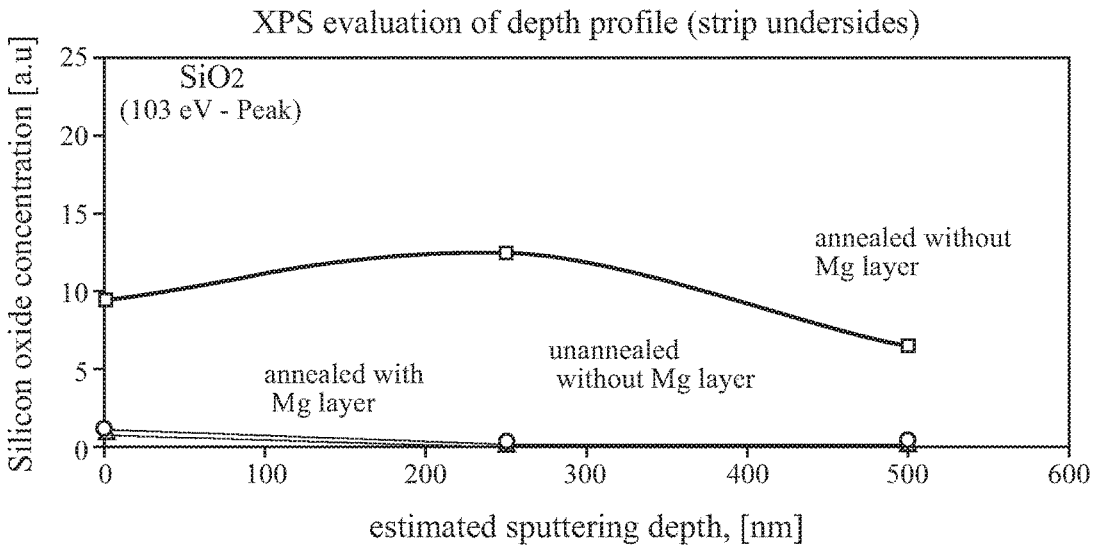
FIG. 11 is a diagram illustrating the influence of a coating on the formation of $SiO_2$ layers on the strip surface.

As the scanning electron microscopy investigation of the strip surfaces as shown in FIG. 10 indicates, the strip surface of the last third of the cores was covered by a dense MgO sinter layer after annealing. As FIG. 8 shows clearly, this prevents the formation of surface crystallites in the air pockets. At the same time, the evaluation of XPS depth profiles recorded in individual sample states and shown in FIG. 11 indicates than an Mg coating suppresses the formation of a strain-inducing $SiO_2$ surface layer. Similar results were obtained with coatings of 1.7% Zr-tetra-isopropyl alkoxide and 4% phenyl titanium tri-isopropyl alkoxide.

In the course of these investigations, the dew point of the $H_2$ and $N_2$ inert gas was discovered to be a further critical parameter in the production of maximum-permeability, magnetostriction-free magnet cores. This becomes more significant as the temperature required for the balance of magnetostriction increases. To investigate this effect, a large number of test annealing processes was performed in the continuous furnace on assemblies of 100 cores having dimensions of 26 mm×10 mm×6 mm produced from a strip of the composition $Fe_{73.13}Co_{0.17}Cu_1Nb_3Si_{15.8}B_{6.9}$. The strips used had an effective roughness $R_a$(eff) of approximately 3% and a fill factor of about 81.5%. The cores were produced in the way described above. The whole strip was coated with a 2.4% solution of Mg methylate.

In the heat treatments, the dew point was varied between −20° C. and −55° C. by mixing humidified and dry $H_2$ gas. A device PARAMETRICS MIS1 was used to measure the dew point.

Figure 12:
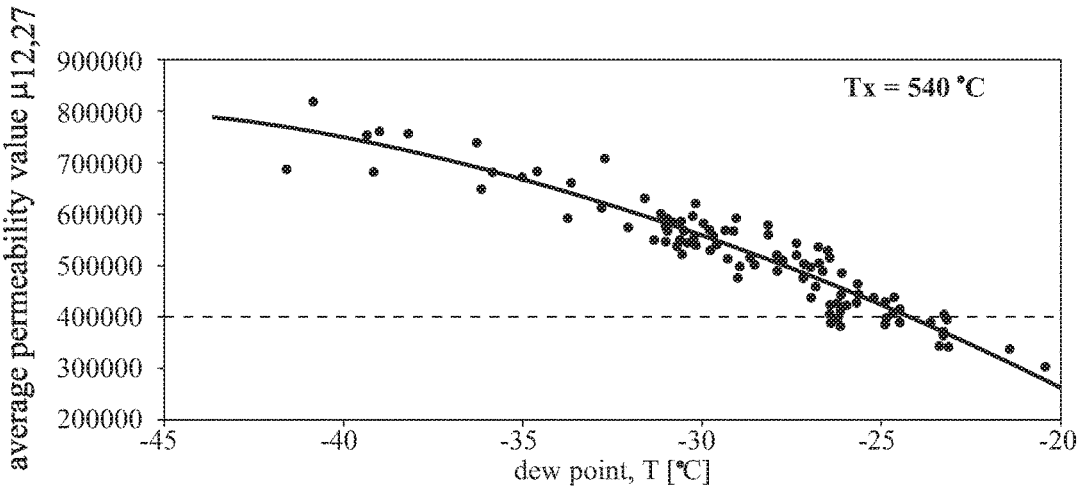
FIG. 12 is a diagram illustrating the influence of the dew point of the inert gas atmosphere during the heat treatment process on permeability.

In these atmospheres, the test cores were annealed on copper plates using the temperatures described with reference to FIG. 2. However, in a first passage the temperature in the maturation zone was adjusted to $T_x$=540° C. without taking account of magnetostriction balance. From the averages of the permeability values measured at 50 Hz and $\hat{H}$=11.27 mA/cm as shown in FIG. 12, we can conclude that in these conditions a dew point of $T_p \leq 25°$ C. is required to obtain $\mu_{11.27}(\approx\mu_{max} \geq 400\ 000$. As expected, all cores proved to be magnetostrictive in a deformation test and could therefore not be processed using the single-trough method commonly applied to magnetostriction-free cores. Special non-straining single-trough methods were required.

Figure 13:
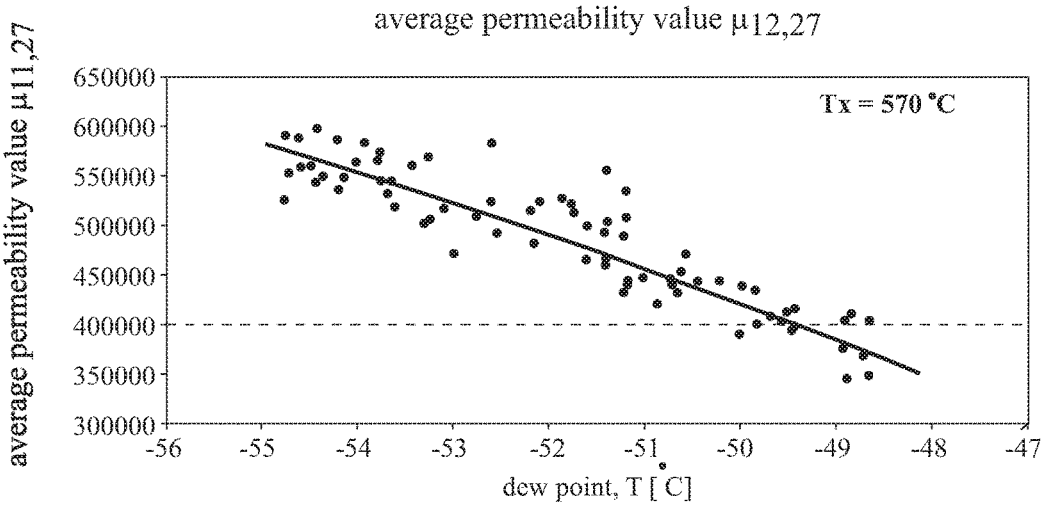
FIG. 13 is a further diagram illustrating the influence of the dew point of the inert gas atmosphere during the heat treatment process on permeability.

In a second run, the optimum temperature for magnetostriction balancing, $T_x$=570° C., which had previously been determined in a pre-sample, was set. The average permeability values measured at 50 Hz and a field strength of 11.27 mA/cm are shown in FIG. 13. It can be seen that in these conditions a dew point of $T_p \leq 49.5°$ C. is required to obtain $\mu_{11.27}(\approx\mu_{max}) \geq 400\ 000$.

In a further test series for limiting the influencing parameters, strip of the composition $Fe_{73.13}Co_{0.17}Cu_1Nb_3Si_{15.8}B_{6.9}$ and having a width of 6 mm was cast on the melt spinning line until the originally almost perfect surface of the casting roll exhibited considerable traces of wear. This wear resulted along the length of the strip in a continuous quality loss reflected in increased surface roughness. The cast strip was wound into coils of approximately the same size, and samples were taken from the beginning, the middle and the end of the coil. These samples were on both surfaces subjected to a measurement of their roughness $R_a$ in a tactile traverse scanning process, and the average thickness of the strip was calculated from the specific weight (as cast 7.07 g/cm$^3$), the length, width and weight of the strip sample. Finally, the effective roughness $R_a$(eff) of the strip samples were determined by dividing the sum of the $R_a$ values of the two surfaces by the strip thickness.

The completely wound coils were coated with three layers of a solution of 19% Zr-tetra-isopropyl alkoxide and then dried for one hour at 130° C. The whole strip was then wound into cores having dimensions of 26 mm×10 mm×6 mm in a strain-free process, maintaining the sequence of cores and their assignment to the original coils. This made it possible to assign to specific cores positions within the coils and therefore a value for $R_a$(eff). After 50 cores each had been placed endwise on square copper plates having dimensions of 300 mm×300 mm×6 mm, a continuous annealing process was carried out using the temperature profile described above with a maturation temperature $T_x$=570° C.

Figure 14:
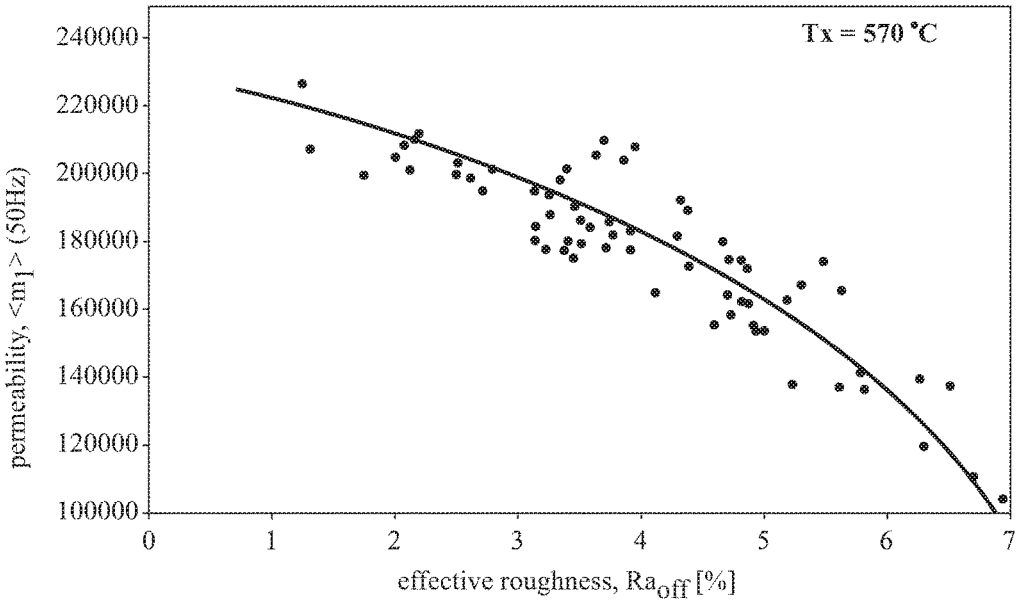
FIG. 14 is a diagram illustrating the influence of effective roughness on starting permeability.

To determine the starting permeability, which depends on strip geometry, the $\mu_1$ values of the cores were measured at 50 Hz and plotted above the effective roughness in FIG. 14. As FIG. 14 shows, an effective roughness of $R_a$(eff) 7% is required for obtaining $\mu_1 \geq 100\ 000$. If $\mu_1$ is to be higher than 160 000, $R_a$(eff) has to be less than 5%, and for $\mu_1 \geq 200\ 000$ even less than 2.5%.

In the test series described above, the annealing process was carried out at a dew point of −53° C. and $T_x$=570° C., which a SAMR magnetostriction measurement indicated to result in $\lambda_s$=0.1 ppm. In view of this, the cores could be bonded into a plastic trough by means of silicone rubber or installed loosely into a plastic or metal protective trough by means of a mechanically damping foam rubber ring without changing their permeability in a significant way.

The results of the investigation are summarised in Table 1. The mark *) indicates fixing with silicone rubber and the mark **) indicates strain-free fixing with a high-viscosity acrylate adhesive.

TABLE 1

| Alloy | Core dimensions | Strip thickness [μm] | Coating | $T_x$ [° C.] | $\mu_1$ unfixed | $\mu_{max}$ unfixed | $\mu_{max}$ fixed |
|---|---|---|---|---|---|---|---|
| $Fe_{73.13}Co_{0.17}Cu_1Nb_3Si_{15.8}B_{6.9}$ | 26.3 × 10.5 × 6.2 | 19.5 | None | 520 | 97 566 | 719 827 | 373 242 *)<br>687 688 **) |
| $Fe_{73.13}Co_{0.17}Cu_1Nb_3Si_{15.8}B_{6.9}$ | 26.3 × 10.5 × 6.2 | 19.5 | None | 575 | 105 311 | 221 435 | 209 432 |

TABLE 1-continued

| Alloy | Core dimensions | Strip thickness [μm] | Coating | $T_x$ [° C.] | $\mu_1$ unfixed | $\mu_{max}$ unfixed | $\mu_{max}$ fixed |
|---|---|---|---|---|---|---|---|
| $Fe_{73.13}Co_{0.17}Cu_1Nb_3Si_{15.8}B_{6.9}$ | 26.3 × 10.5 × 6.2 | 19.5 | Mg methylate (3%) | 575 | 244 562 | 692 163 | 677 322 |
| $Fe_{73.13}Co_{0.17}Cu_1Nb_3Si_{15.8}B_{6.9}$ | 26.3 × 10.5 × 6.2 | 21.0 | Mg methylate (3%) | 575 | 178 364 | 618 215 | 607 224 |
| $Fe_{73.13}Co_{0.17}Cu_1Nb_3Si_{15.8}B_{6.9}$ | 26.3 × 10.5 × 6.2 | 24.0 | Mg methylate (3%) | 575 | 63 078 | 188 474 | — |
| $Fe_{73.13}Co_{0.17}Cu_1Nb_3Si_{15.8}B_{6.9}$ | 26.3 × 10.5 × 6.2 | 19.5 | Mg methylate (0.3%) | 575 | 229 528 | 642 999 | 639 623 |
| $Fe_{73.13}Co_{0.17}Cu_1Nb_3Si_{15.8}B_{6.9}$ | 26.3 × 10.5 × 6.2 | 19.5 | Ti propylate (1%), 3 layers | 575 | 198 466 | 621 523 | 615 872 |
| $Fe_{73.13}Co_{0.17}Cu_1Nb_3Si_{15.8}B_{6.9}$ | 26.3 × 10.5 × 6.2 | 19.5 | Ti butylate (4%), 4 layers | 550 | 132 321 | 588 478 | 368 662 *) 581 014 **) |
| $Fe_{73.13}Co_{0.17}Cu_1Nb_3Si_{15.8}B_{6.9}$ | 26.3 × 10.5 × 6.2 | 19.5 | Zr propylate (2%), 3 layers | 575 | 192 833 | 647 174 | 642 445 |
| $Fe_{73.13}Co_{0.17}Cu_1Nb_3Si_{15.8}B_{6.9}$ | 26.3 × 10.5 × 6.2 | 19.5 | K methylate (3%) | 575 | 47 642 | 68 540 | — |
| $Fe_{72.13}Co_{0.17}Cu_1Nb_3Si_{15.8}B_{6.9}$ | 26.3 × 10.5 × 6.2 | 19.5 | K propylate (0.3%) | 575 | 51 684 | 86 262 | — |
| $Fe_{72.53}Co_{0.11}Cu_{1.1}Nb_3Si_{16.5}B_{6.75}Co_{0.11}$ | 26.3 × 10.5 × 6.2 | 19.5 | Mg methylate (4%) | 585 | 173 354 | 662 551 | 392 444 *) 658 676 **) |
| $Fe_{72.53}Co_{0.11}Cu_{1.1}Nb_3Si_{16.5}B_{6.75}Co_{0.11}$ | 26.3 × 10.5 × 6.2 | 19.5 | Mg methylate (4%) | 562 | 209 471 | 708 422 | 706 843 |
| $Fe_{72.43}Co_{0.08}Cu_{0.98}Nb_{2.9}Si_{15.45}B_{6.95}Co_{0.21}$ | 26.3 × 10.5 × 6.2 | 19.5 | Mg methylate (4%) | 562 | 126 927 | 565 618 | 382 464 *) 529 930 **) |
| $Fe_{72.43}Co_{0.08}Cu_{0.98}Nb_{2.9}Si_{15.45}B_{6.95}Co_{0.21}$ | 26.3 × 10.5 × 6.2 | 19.5 | Mg methylate (4%) | 585 | 231 738 | 712 486 | 709 686 |
| $Fe_{73.13}Co_{0.17}Cu_1Nb_3Si_{15.8}B_{6.9}$ | 10.5 × 7 × 4.5 | 19.5 | Mg methylate (3%) | 575 | 188 431 | 629 644 | 632 381 |
| $Fe_{73.13}Co_{0.17}Cu_1Nb_3Si_{15.8}B_{6.9}$ | 180 × 140 × 20 | 19.5 | Mg methylate (3%) | 575 | 172 524 | 646 813 | 631 117 |

The invention claimed is:

1. A method for producing a magnet core for low-frequency applications from a soft-magnetic, nanocrystalline strip, the strip essentially having the alloy composition $Fe_{Rest}Co_aCu_bNb_cSi_dB_eC_f$, wherein a, b, c, d, e and f are stated in atomic percent and $0 \leq a \leq 1$; $0.7 \leq b \leq 1.4$; $2.5 \leq c \leq 3.5$; $14.5 \leq d \leq 16.5$; $5.5 \leq e \leq 8$ and $0 \leq f \leq 1$, and cobalt may wholly or partially be replaced by nickel; wherein the strip is provided with a coating, the coating provided on the strip comprising a solution, the solution including a methylate, an ethylate, or a butylate compound in the corresponding alcohol or ether, or the solution including a tri- or tetra-isopropyl alkoxide, or the solution including an acetyl-acetone-chelate complex, the coating provided on the strip further includes a metal, the metal includes an element selected from the group of Mg, Zr, Be, Al, Ti, V, Nb, Ta, Ce, Nd, Gd, elements of Group 2 and Group 3 of the Period Table of the Elements, and elements of the group of rare earth metals of the Period Table of the Elements, which coating forms a seal on the strip during a subsequent heat treatment at a temperature greater than 540° C. for the nanocrystallisation of the strip and thus hinders formation of surface crystallites and a strain-inducing $SiO_2$ surface layer on the strip, wherein the heat treatment is carried out magnetic field-free on non-stacked magnet cores in a continuous annealing process, and wherein, in the heat treatment for the nanocrystallisation of the strip, a saturation magnetostriction $\lambda_s$ of $|\lambda_s|<2$ ppm is achieved, and wherein the strip also has a remanence ratio $B_r/B_s>70\%$, a starting permeability $\mu_1$ of $\mu_1>100\,000$, and a maximum permeability $\mu_{max}$ of $\mu_{max}>400\,000$ after exposure to the temperature of greater than 540° C. and when the core operates at a frequency of 50 Hz.

2. The method according to claim 1, wherein a saturation magnetostriction $\lambda_s$ of $|\lambda_s|<1$ ppm is achieved in the heat treatment process.

3. The method according to claim 2, wherein a saturation magnetostriction $\lambda_s$ of $|\lambda_s|<0.5$ ppm is achieved in the heat treatment process.

4. The method according to claim 1, wherein the non-stacked magnet cores are placed on a carrier having a thermal conductivity in the continuous annealing process.

5. The method according to claim 1, wherein the magnet core passes through the following temperature zones in the heat treatment process: a first heating zone in which the magnet core is heated to a crystallization temperature; a constant or rising decay zone with a temperature above the crystallization temperature, the passage through the decay zone lasting at least 10 minutes; a second heating zone in which the magnet core is heated to a maturation temperature for setting the nanocrystalline structure; a maturation zone with a substantially constant maturation temperature $T_x$ between 540° C. and 600° C., the passage through the maturation zone lasting at least 15 minutes.

6. The method according to claim 1, wherein the heat treatment is carried out in an inert gas atmosphere of $H_2$, $N_2$ and/or Ar, the dew point $T_P$ being <−25° C.

7. The method according to claim 6, wherein the dew point $T_P$ is <−49.5° C.

8. The method according to claim 1, wherein the coating includes magnesium (Mg) methylate.

9. The method according to claim 1, wherein the metal is dissolved in the coating and has a concentration between 0.1% and 5% by weight of the coating.

10. The method according to claim 1 including continuously drawing the strip via deflection rollers through the coating placed in a trough, and passing the strip through a drying section at a temperature of 80 to 200° C. before winding the strip.

11. The method according to claim 1, wherein the metal of the coating is selected from the group consisting of Mg, Zr, and Ti.

12. The method according to claim 1 including spiral winding the strip including the sealing coating to form the magnetic core for the low-frequency applications.

13. A method for producing a magnet core for low-frequency applications from a soft-magnetic, nanocrystalline strip, the strip essentially having the alloy composition $Fe_{Rest}Co_aCu_bNb_cSi_dB_eC_f$, wherein a, b, c, d, e and f are stated in atomic percent and $0 \leq a \leq 1$; $0.7 \leq b \leq 1.4$; $2.5 \leq c \leq 3.5$; $14.5 \leq d \leq 16.5$; $5.5 \leq e \leq 8$ and $0 \leq f \leq 1$, and cobalt may wholly or partially be replaced by nickel; wherein the strip is provided with a coating, the coating provided on the strip comprising a solution, the solution including a methylate, an ethylate, or a butylate compound in the corresponding alcohol or ether, or the solution including a tri- or tetra-isopropyl alkoxide, or the solution including an acetyl-acetone-chelate complex, the coating further includes a metal, the metal includes an element selected from the group of Mg, Zr, Be, Al, Ti, V, Nb, Ta, Ce, Nd, Gd, elements of Group 2 or Group 3 of the Periodic Table of the Elements, and elements of the group of rare earth metals of the Periodic Table of the Elements, which coating forms a sealing coating during a subsequent heat treatment for the nanocrystallisation of the strip, and wherein, in the heat treatment for the nanocrystallisation of the strip, a saturation magnetostriction $\lambda_s$ of $|\lambda_s|<2$ ppm is set; and including the steps of winding the strip into a coil, dipping the coil into the coating in a receiver, evacuating the coil from the coating, disposing the coil in a vacuum at a range of 10 to 300 mbar, drying the coil, and post drying the coil in a drying cabinet at 80-200° C.

14. A method for producing a magnet core for low-frequency applications from a soft-magnetic, nanocrystalline strip, the strip essentially having the alloy composition $Fe_{Rest}Co_aCu_bNb_cSi_dB_eC_f$, wherein a, b, c, d, e and f are stated in atomic percent and $0 \leq a \leq 1$; $0.7 \leq b \leq 1.4$; $2.5 \leq c \leq 3.5$; $14.5 \leq d \leq 16.5$; $5.5 \leq e \leq 8$ and $0 \leq f \leq 1$, and cobalt may wholly or partially be replaced by nickel; wherein the strip is provided with a coating, the coating provided on the strip comprising a solution, the solution including a methylate, an ethylate, or a butylate compound in the corresponding alcohol or ether, or the solution including a tri- or tetra-isopropyl alkoxide, or the solution including an acetyl-acetone-chelate complex, the coating further includes a metal, the metal includes an element selected from the group of Mg, Zr, Be, Al, Ti, V, Nb, Ta, Ce, Nd, Gd, elements of Group 2 or Group 3 of the Periodic Table of the Elements, and elements of the group of rare earth metals of the Periodic Table of the Elements, which coating forms a sealing coating during a subsequent heat treatment for the nanocrystallisation of the strip, and wherein, in the heat treatment for the nanocrystallisation of the strip, a saturation magnetostriction $\lambda_s$ of $|\lambda_s|<2$ ppm is set; and including the steps of including dipping the strip in the coating in a receiver, evacuating the strip from the coating, disposing the strip in a vacuum at a range of 10 to 300 mbar, and drying the strip at 80 at 200° C.

* * * * *